US010232628B1

(12) United States Patent
Yap et al.

(10) Patent No.: US 10,232,628 B1
(45) Date of Patent: Mar. 19, 2019

(54) REMOVABLY RETAINING A PRINT HEAD ASSEMBLY ON A PRINTER

(71) Applicant: Datamax-O'Neil Corporation, Orlando, FL (US)

(72) Inventors: Yaw Horng Yap, Singapore (SG); Boon Kheng Lim, Singapore (SG); Florante Sumalinog Go, Singapore (SG)

(73) Assignee: DATAMAX-O'NEIL CORPORATION, Orlando, FL (US)

( * ) Notice: Subject to any disclaimer, the term of this patent is extended or adjusted under 35 U.S.C. 154(b) by 0 days.

(21) Appl. No.: 15/836,012

(22) Filed: Dec. 8, 2017

(51) Int. Cl.
*B41J 2/175* (2006.01)
*B41J 2/335* (2006.01)

(52) U.S. Cl.
CPC ..... *B41J 2/1752* (2013.01); *B41J 2/33505* (2013.01); *B41J 2202/14* (2013.01)

(58) Field of Classification Search
CPC ... B41J 2/1752; B41J 2/33505; B41J 2202/14
See application file for complete search history.

(56) References Cited

U.S. PATENT DOCUMENTS

| | | | | |
|---|---|---|---|---|
| 6,832,725 | B2 | 12/2004 | Gardiner et al. | |
| 7,128,266 | B2 | 10/2006 | Zhu et al. | |
| 7,159,783 | B2 | 1/2007 | Walczyk et al. | |
| 7,413,127 | B2 | 8/2008 | Ehrhart et al. | |
| 7,726,575 | B2 | 6/2010 | Wang et al. | |
| 8,210,517 | B2 * | 7/2012 | Osakabe | H04N 1/0057 271/3.18 |
| 8,294,969 | B2 | 10/2012 | Plesko | |
| 8,317,105 | B2 | 11/2012 | Kotlarsky et al. | |
| 8,322,622 | B2 | 12/2012 | Liu | |
| 8,366,005 | B2 | 2/2013 | Kotlarsky et al. | |
| 8,371,507 | B2 | 2/2013 | Haggerty et al. | |
| 8,376,233 | B2 | 2/2013 | Van Horn et al. | |
| 8,381,979 | B2 | 2/2013 | Franz | |
| 8,390,909 | B2 | 3/2013 | Plesko | |
| 8,408,464 | B2 | 4/2013 | Zhu et al. | |

(Continued)

FOREIGN PATENT DOCUMENTS

| | | | |
|---|---|---|---|
| JP | 2015000549 | A | 1/2015 |
| WO | 2013163789 | A1 | 11/2013 |

OTHER PUBLICATIONS

Datamax—O'Neil, "H-class Replacement Parts Catalog", downloaded Apr. 4, 2017, 34 pages.

(Continued)

*Primary Examiner* — Lamson Nguyen
(74) *Attorney, Agent, or Firm* — Additon, Higgins & Pendleton, P.A.

(57) ABSTRACT

A system for removably retaining a print head assembly includes a bracket holding a print head assembly and a shaft for receiving the bracket on the shaft. The shaft includes a retaining assembly, a first shaft section having a profile geometry to allow the bracket to be received onto the shaft, a second shaft section having a profile geometry preventing removal of the bracket from the shaft, and a positioning assembly configured to resiliently engage the bracket. When the bracket is received on the shaft at the first shaft section, the positioning assembly can engage and releasably reposition the bracket onto the second shaft section and against the retaining assembly.

20 Claims, 5 Drawing Sheets

(56) References Cited

U.S. PATENT DOCUMENTS

| | | | |
|---|---|---|---|
| 8,408,468 | B2 | 4/2013 | Horn et al. |
| 8,408,469 | B2 | 4/2013 | Good |
| 8,424,768 | B2 | 4/2013 | Rueblinger et al. |
| 8,448,863 | B2 | 5/2013 | Xian et al. |
| 8,457,013 | B2 | 6/2013 | Essinger et al. |
| 8,459,557 | B2 | 6/2013 | Havens et al. |
| 8,469,272 | B2 | 6/2013 | Kearney |
| 8,474,712 | B2 | 7/2013 | Kearney et al. |
| 8,479,992 | B2 | 7/2013 | Kotlarsky et al. |
| 8,490,877 | B2 | 7/2013 | Kearney |
| 8,517,271 | B2 | 8/2013 | Kotlarsky et al. |
| 8,523,076 | B2 | 9/2013 | Good |
| 8,528,818 | B2 | 9/2013 | Ehrhart et al. |
| 8,544,737 | B2 | 10/2013 | Gomez et al. |
| 8,548,420 | B2 | 10/2013 | Grunow et al. |
| 8,550,335 | B2 | 10/2013 | Samek et al. |
| 8,550,354 | B2 | 10/2013 | Gannon et al. |
| 8,550,357 | B2 | 10/2013 | Kearney |
| 8,556,174 | B2 | 10/2013 | Kosecki et al. |
| 8,556,176 | B2 | 10/2013 | Van Horn et al. |
| 8,556,177 | B2 | 10/2013 | Hussey et al. |
| 8,559,767 | B2 | 10/2013 | Barber et al. |
| 8,561,895 | B2 | 10/2013 | Gomez et al. |
| 8,561,903 | B2 | 10/2013 | Sauerwein |
| 8,561,905 | B2 | 10/2013 | Edmonds et al. |
| 8,565,107 | B2 | 10/2013 | Pease et al. |
| 8,571,307 | B2 | 10/2013 | Li et al. |
| 8,579,200 | B2 | 11/2013 | Samek et al. |
| 8,583,924 | B2 | 11/2013 | Caballero et al. |
| 8,584,945 | B2 | 11/2013 | Wang et al. |
| 8,587,595 | B2 | 11/2013 | Wang |
| 8,587,697 | B2 | 11/2013 | Hussey et al. |
| 8,588,869 | B2 | 11/2013 | Sauerwein et al. |
| 8,590,789 | B2 | 11/2013 | Nahill et al. |
| 8,596,539 | B2 | 12/2013 | Havens et al. |
| 8,596,542 | B2 | 12/2013 | Havens et al. |
| 8,596,543 | B2 | 12/2013 | Havens et al. |
| 8,599,271 | B2 | 12/2013 | Havens et al. |
| 8,599,957 | B2 | 12/2013 | Peake et al. |
| 8,600,158 | B2 | 12/2013 | Li et al. |
| 8,600,167 | B2 | 12/2013 | Showering |
| 8,602,309 | B2 | 12/2013 | Longacre et al. |
| 8,608,053 | B2 | 12/2013 | Meier et al. |
| 8,608,071 | B2 | 12/2013 | Liu et al. |
| 8,611,309 | B2 | 12/2013 | Wang et al. |
| 8,615,487 | B2 | 12/2013 | Gomez et al. |
| 8,621,123 | B2 | 12/2013 | Caballero |
| 8,622,303 | B2 | 1/2014 | Meier et al. |
| 8,628,013 | B2 | 1/2014 | Ding |
| 8,628,015 | B2 | 1/2014 | Wang et al. |
| 8,628,016 | B2 | 1/2014 | Winegar |
| 8,629,926 | B2 | 1/2014 | Wang |
| 8,630,491 | B2 | 1/2014 | Longacre et al. |
| 8,635,309 | B2 | 1/2014 | Berthiaume et al. |
| 8,636,200 | B2 | 1/2014 | Kearney |
| 8,636,212 | B2 | 1/2014 | Nahill et al. |
| 8,636,215 | B2 | 1/2014 | Ding et al. |
| 8,636,224 | B2 | 1/2014 | Wang |
| 8,638,806 | B2 | 1/2014 | Wang et al. |
| 8,640,958 | B2 | 2/2014 | Lu et al. |
| 8,640,960 | B2 | 2/2014 | Wang et al. |
| 8,643,717 | B2 | 2/2014 | Li et al. |
| 8,646,692 | B2 | 2/2014 | Meier et al. |
| 8,646,694 | B2 | 2/2014 | Wang et al. |
| 8,657,200 | B2 | 2/2014 | Ren et al. |
| 8,659,397 | B2 | 2/2014 | Vargo et al. |
| 8,668,149 | B2 | 3/2014 | Good |
| 8,678,285 | B2 | 3/2014 | Kearney |
| 8,678,286 | B2 | 3/2014 | Smith et al. |
| 8,682,077 | B1 | 3/2014 | Longacre |
| D702,237 | S | 4/2014 | Oberpriller et al. |
| 8,687,282 | B2 | 4/2014 | Feng et al. |
| 8,692,927 | B2 | 4/2014 | Pease et al. |
| 8,695,880 | B2 | 4/2014 | Bremer et al. |
| 8,698,949 | B2 | 4/2014 | Grunow et al. |
| 8,702,000 | B2 | 4/2014 | Barber et al. |
| 8,717,494 | B2 | 5/2014 | Gannon |
| 8,720,783 | B2 | 5/2014 | Biss et al. |
| 8,723,804 | B2 | 5/2014 | Fletcher et al. |
| 8,723,904 | B2 | 5/2014 | Marty et al. |
| 8,727,223 | B2 | 5/2014 | Wang |
| 8,740,082 | B2 | 6/2014 | Wilz |
| 8,740,085 | B2 | 6/2014 | Furlong et al. |
| 8,746,563 | B2 | 6/2014 | Hennick et al. |
| 8,750,445 | B2 | 6/2014 | Peake et al. |
| 8,752,766 | B2 | 6/2014 | Xian et al. |
| 8,756,059 | B2 | 6/2014 | Braho et al. |
| 8,757,495 | B2 | 6/2014 | Qu et al. |
| 8,760,563 | B2 | 6/2014 | Koziol et al. |
| 8,763,909 | B2 | 7/2014 | Reed et al. |
| 8,777,108 | B2 | 7/2014 | Coyle |
| 8,777,109 | B2 | 7/2014 | Oberpriller et al. |
| 8,779,898 | B2 | 7/2014 | Havens et al. |
| 8,781,520 | B2 | 7/2014 | Payne et al. |
| 8,783,573 | B2 | 7/2014 | Havens et al. |
| 8,789,757 | B2 | 7/2014 | Barten |
| 8,789,758 | B2 | 7/2014 | Hawley et al. |
| 8,789,759 | B2 | 7/2014 | Xian et al. |
| 8,794,520 | B2 | 8/2014 | Wang et al. |
| 8,794,522 | B2 | 8/2014 | Ehrhart |
| 8,794,525 | B2 | 8/2014 | Amundsen et al. |
| 8,794,526 | B2 | 8/2014 | Wang et al. |
| 8,798,367 | B2 | 8/2014 | Ellis |
| 8,807,431 | B2 | 8/2014 | Wang et al. |
| 8,807,432 | B2 | 8/2014 | Van Horn et al. |
| 8,820,630 | B2 | 9/2014 | Qu et al. |
| 8,822,848 | B2 | 9/2014 | Meagher |
| 8,824,692 | B2 | 9/2014 | Sheerin et al. |
| 8,824,696 | B2 | 9/2014 | Braho |
| 8,842,849 | B2 | 9/2014 | Wahl et al. |
| 8,844,822 | B2 | 9/2014 | Kotlarsky et al. |
| 8,844,823 | B2 | 9/2014 | Fritz et al. |
| 8,849,019 | B2 | 9/2014 | Li et al. |
| D716,285 | S | 10/2014 | Chaney et al. |
| 8,851,383 | B2 | 10/2014 | Yeakley et al. |
| 8,854,633 | B2 | 10/2014 | Laffargue |
| 8,866,963 | B2 | 10/2014 | Grunow et al. |
| 8,868,421 | B2 | 10/2014 | Braho et al. |
| 8,868,519 | B2 | 10/2014 | Maloy et al. |
| 8,868,802 | B2 | 10/2014 | Barten |
| 8,868,803 | B2 | 10/2014 | Caballero |
| 8,870,074 | B1 | 10/2014 | Gannon |
| 8,879,639 | B2 | 11/2014 | Sauerwein |
| 8,880,426 | B2 | 11/2014 | Smith |
| 8,881,983 | B2 | 11/2014 | Havens et al. |
| 8,881,987 | B2 | 11/2014 | Wang |
| 8,903,172 | B2 | 12/2014 | Smith |
| 8,908,995 | B2 | 12/2014 | Benos et al. |
| 8,910,870 | B2 | 12/2014 | Li et al. |
| 8,910,875 | B2 | 12/2014 | Ren et al. |
| 8,914,290 | B2 | 12/2014 | Hendrickson et al. |
| 8,914,788 | B2 | 12/2014 | Pettinelli et al. |
| 8,915,439 | B2 | 12/2014 | Feng et al. |
| 8,915,444 | B2 | 12/2014 | Havens et al. |
| 8,916,789 | B2 | 12/2014 | Woodburn |
| 8,918,250 | B2 | 12/2014 | Hollifield |
| 8,918,564 | B2 | 12/2014 | Caballero |
| 8,925,818 | B2 | 1/2015 | Kosecki et al. |
| 8,939,374 | B2 | 1/2015 | Jovanovski et al. |
| 8,942,480 | B2 | 1/2015 | Ellis |
| 8,944,313 | B2 | 2/2015 | Williams et al. |
| 8,944,327 | B2 | 2/2015 | Meier et al. |
| 8,944,332 | B2 | 2/2015 | Harding et al. |
| 8,950,678 | B2 | 2/2015 | Germaine et al. |
| D723,560 | S | 3/2015 | Zhou et al. |
| 8,967,468 | B2 | 3/2015 | Gomez et al. |
| 8,971,346 | B2 | 3/2015 | Sevier |
| 8,976,030 | B2 | 3/2015 | Cunningham et al. |
| 8,976,368 | B2 | 3/2015 | Akel et al. |
| 8,978,981 | B2 | 3/2015 | Guan |
| 8,978,983 | B2 | 3/2015 | Bremer et al. |
| 8,978,984 | B2 | 3/2015 | Hennick et al. |
| 8,985,456 | B2 | 3/2015 | Zhu et al. |
| 8,985,457 | B2 | 3/2015 | Soule et al. |

(56) References Cited

U.S. PATENT DOCUMENTS

| | | | |
|---|---|---|---|
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,061,527 | B2 | 6/2015 | Tobin et al. |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,076,459 | B2 | 7/2015 | Braho et al. |
| 9,079,423 | B2 | 7/2015 | Bouverie et al. |
| 9,080,856 | B2 | 7/2015 | Laffargue |
| 9,082,023 | B2 | 7/2015 | Feng et al. |
| 9,084,032 | B2 | 7/2015 | Rautiola et al. |
| 9,087,250 | B2 | 7/2015 | Coyle |
| 9,092,681 | B2 | 7/2015 | Havens et al. |
| 9,092,682 | B2 | 7/2015 | Wilz et al. |
| 9,092,683 | B2 | 7/2015 | Koziol et al. |
| 9,093,141 | B2 | 7/2015 | Liu |
| 9,098,763 | B2 | 8/2015 | Lu et al. |
| 9,104,929 | B2 | 8/2015 | Todeschini |
| 9,104,934 | B2 | 8/2015 | Li et al. |
| 9,107,484 | B2 | 8/2015 | Chaney |
| 9,111,159 | B2 | 8/2015 | Liu et al. |
| 9,111,166 | B2 | 8/2015 | Cunningham |
| 9,135,483 | B2 | 9/2015 | Liu et al. |
| 9,137,009 | B1 | 9/2015 | Gardiner |
| 9,141,839 | B2 | 9/2015 | Xian et al. |
| 9,147,096 | B2 | 9/2015 | Wang |
| 9,148,474 | B2 | 9/2015 | Skvoretz |
| 9,158,000 | B2 | 10/2015 | Sauerwein |
| 9,158,340 | B2 | 10/2015 | Reed et al. |
| 9,158,953 | B2 | 10/2015 | Gillet et al. |
| 9,159,059 | B2 | 10/2015 | Daddabbo et al. |
| 9,165,174 | B2 | 10/2015 | Huck |
| 9,171,543 | B2 | 10/2015 | Emerick et al. |
| 9,183,425 | B2 | 11/2015 | Wang |
| 9,189,669 | B2 | 11/2015 | Zhu et al. |
| 9,195,844 | B2 | 11/2015 | Todeschini et al. |
| 9,202,458 | B2 | 12/2015 | Braho et al. |
| 9,208,366 | B2 | 12/2015 | Liu |
| 9,208,367 | B2 | 12/2015 | Wang |
| 9,219,836 | B2 | 12/2015 | Bouverie et al. |
| 9,224,022 | B2 | 12/2015 | Ackley et al. |
| 9,224,024 | B2 | 12/2015 | Bremer et al. |
| 9,224,027 | B2 | 12/2015 | Van Horn et al. |
| D747,321 | S | 1/2016 | London et al. |
| 9,230,140 | B1 | 1/2016 | Ackley |
| 9,235,553 | B2 | 1/2016 | Fitch et al. |
| 9,239,950 | B2 | 1/2016 | Fletcher |
| 9,245,492 | B2 | 1/2016 | Ackley et al. |
| 9,443,123 | B2 | 1/2016 | Hejl |
| 9,248,640 | B2 | 2/2016 | Heng |
| 9,250,652 | B2 | 2/2016 | London et al. |
| 9,250,712 | B1 | 2/2016 | Todeschini |
| 9,251,411 | B2 | 2/2016 | Todeschini |
| 9,258,033 | B2 | 2/2016 | Showering |
| 9,261,133 | B2 | 2/2016 | Gassoway et al. |
| 9,262,633 | B1 | 2/2016 | Todeschini et al. |
| 9,262,660 | B2 | 2/2016 | Lu et al. |
| 9,262,662 | B2 | 2/2016 | Chen et al. |
| 9,269,036 | B2 | 2/2016 | Bremer |
| 9,270,782 | B2 | 2/2016 | Hala et al. |
| 9,274,812 | B2 | 3/2016 | Doren et al. |
| 9,275,388 | B2 | 3/2016 | Havens et al. |
| 9,277,668 | B2 | 3/2016 | Feng et al. |
| 9,280,693 | B2 | 3/2016 | Feng et al. |
| 9,286,496 | B2 | 3/2016 | Smith |
| 9,297,900 | B2 | 3/2016 | Jiang |
| 9,298,964 | B2 | 3/2016 | Li et al. |
| 9,301,427 | B2 | 3/2016 | Feng et al. |
| 9,304,376 | B2 | 4/2016 | Anderson |
| 9,310,609 | B2 | 4/2016 | Rueblinger et al. |
| 9,313,377 | B2 | 4/2016 | Todeschini et al. |
| 9,317,037 | B2 | 4/2016 | Byford et al. |
| D757,009 | S | 5/2016 | Oberpriller et al. |
| 9,342,723 | B2 | 5/2016 | Liu et al. |
| 9,342,724 | B2 | 5/2016 | McCloskey |
| 9,361,882 | B2 | 6/2016 | Ressler et al. |
| 9,365,381 | B2 | 6/2016 | Colonel et al. |
| 9,373,018 | B2 | 6/2016 | Colavito et al. |
| 9,375,945 | B1 | 6/2016 | Bowles |
| 9,378,403 | B2 | 6/2016 | Wang et al. |
| D760,719 | S | 7/2016 | Zhou et al. |
| 9,360,304 | B2 | 7/2016 | Chang et al. |
| 9,383,848 | B2 | 7/2016 | Daghigh |
| 9,384,374 | B2 | 7/2016 | Bianconi |
| 9,390,596 | B1 | 7/2016 | Todeschini |
| D762,604 | S | 8/2016 | Fitch et al. |
| 9,411,386 | B2 | 8/2016 | Sauerwein |
| 9,412,242 | B2 | 8/2016 | Van Horn et al. |
| 9,418,269 | B2 | 8/2016 | Havens et al. |
| 9,418,270 | B2 | 8/2016 | Van Volkinburg et al. |
| 9,423,318 | B2 | 8/2016 | Lui et al. |
| D766,244 | S | 9/2016 | Zhou et al. |
| 9,443,222 | B2 | 9/2016 | Singel et al. |
| 9,454,689 | B2 | 9/2016 | McCloskey et al. |
| 9,464,885 | B2 | 10/2016 | Lloyd et al. |
| 9,465,967 | B2 | 10/2016 | Xian et al. |
| 9,478,113 | B2 | 10/2016 | Xie et al. |
| 9,478,983 | B2 | 10/2016 | Kather et al. |
| D771,631 | S | 11/2016 | Fitch et al. |
| 9,481,186 | B2 | 11/2016 | Bouverie et al. |
| 9,488,986 | B1 | 11/2016 | Solanki |
| 9,489,782 | B2 | 11/2016 | Payne et al. |
| 9,490,540 | B1 | 11/2016 | Davies et al. |
| 9,491,729 | B2 | 11/2016 | Rautiola et al. |
| 9,497,092 | B2 | 11/2016 | Gomez et al. |
| 9,507,974 | B1 | 11/2016 | Todeschini |
| 9,519,814 | B2 | 12/2016 | Cudzilo |
| 9,521,331 | B2 | 12/2016 | Bessettes et al. |
| 9,530,038 | B2 | 12/2016 | Xian et al. |
| D777,166 | S | 1/2017 | Bidwell et al. |
| 9,558,386 | B2 | 1/2017 | Yeakley |
| 9,572,901 | B2 | 2/2017 | Todeschini |
| 9,606,581 | B1 | 3/2017 | Howe et al. |
| D783,601 | S | 4/2017 | Schulte et al. |
| 9,623,678 | B1 * | 4/2017 | Arredondo ..... B41J 11/0085 |
| D785,617 | S | 5/2017 | Bidwell et al. |

(56) References Cited

U.S. PATENT DOCUMENTS

D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0186703 A1 7/2015 Chen et al.
2015/0199957 A1 7/2015 Funyak et al.
2015/0210199 A1 7/2015 Payne
2015/0220753 A1 8/2015 Zhu et al.
2015/0254485 A1 9/2015 Feng et al.
2015/0310243 A1 10/2015 Ackley
2015/0310389 A1 10/2015 Crimm et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0092805 A1 3/2016 Geisler et al.
2016/0101936 A1 4/2016 Chamberlin
2016/0102975 A1 4/2016 McCloskey et al.

(56) References Cited

U.S. PATENT DOCUMENTS

2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr et al.
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Linwood
2016/0188944 A1 6/2016 Wilz et al.
2016/0189076 A1 6/2016 Mellott et al.
2016/0189087 A1 6/2016 Morton et al.
2016/0189088 A1 6/2016 Percorari et al.
2016/0189092 A1 6/2016 George et al.
2016/0189284 A1 6/2016 Mellott et al.
2016/0189288 A1 6/2016 Todeschini
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 DiPiazza et al.
2016/0192051 A1 6/2016 DiPiazza et al.
2016/0125873 A1 7/2016 Braho et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggert et al.
2016/0204636 A1 7/2016 Allen et al.
2016/0204638 A1 7/2016 Miraglia et al.
2016/0316190 A1 7/2016 McCloskey et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.
2016/0323310 A1 11/2016 Todeschini et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley
2016/0364914 A1 12/2016 Todeschini
2016/0370220 A1 12/2016 Ackley et al.
2016/0372282 A1 12/2016 Bandringa
2016/0373847 A1 12/2016 Vargo et al.
2016/0377414 A1 12/2016 Thuries et al.
2016/0377417 A1 12/2016 Jovanovski et al.
2017/0010141 A1 1/2017 Ackley
2017/0010328 A1 1/2017 Mullen et al.
2017/0010780 A1 1/2017 Waldron et al.
2017/0016714 A1 1/2017 Laffargue et al.
2017/0018094 A1 1/2017 Todeschini
2017/0046603 A1 2/2017 Lee et al.
2017/0047864 A1 2/2017 Stang et al.
2017/0053146 A1 2/2017 Liu et al.
2017/0053147 A1 2/2017 Geramine et al.
2017/0053647 A1 2/2017 Nichols et al.
2017/0055606 A1 3/2017 Xu et al.
2017/0060316 A1 3/2017 Larson
2017/0061961 A1 3/2017 Nichols et al.
2017/0064634 A1 3/2017 Van Horn et al.
2017/0083730 A1 3/2017 Feng et al.
2017/0091502 A1 3/2017 Furlong et al.
2017/0091706 A1 3/2017 Lloyd et al.
2017/0091741 A1 3/2017 Todeschini
2017/0091904 A1 3/2017 Ventress
2017/0092908 A1 3/2017 Chaney
2017/0094238 A1 3/2017 Germaine et al.
2017/0098947 A1 4/2017 Wolski
2017/0100949 A1 4/2017 Celinder et al.
2017/0108838 A1 4/2017 Todeschinie et al.
2017/0108895 A1 4/2017 Chamberlin et al.
2017/0118355 A1 4/2017 Wong et al.
2017/0123598 A1 5/2017 Phan et al.
2017/0124369 A1 5/2017 Rueblinger et al.
2017/0124396 A1 5/2017 Todeschini et al.
2017/0124687 A1 5/2017 McCloskey et al.
2017/0126873 A1 5/2017 McGary et al.
2017/0126904 A1 5/2017 d'Armancourt et al.
2017/0139012 A1 5/2017 Smith
2017/0140329 A1 5/2017 Bernhardt et al.
2017/0140731 A1 5/2017 Smith
2017/0147847 A1 5/2017 Berggren et al.
2017/0150124 A1 5/2017 Thuries
2017/0169198 A1 6/2017 Nichols
2017/0171035 A1 6/2017 Lu et al.
2017/0171703 A1 6/2017 Maheswaranathan
2017/0171803 A1 6/2017 Maheswaranathan
2017/0180359 A1 6/2017 Wolski et al.
2017/0180577 A1 6/2017 Nguon et al.
2017/0181299 A1 6/2017 Shi et al.
2017/0190192 A1 7/2017 Delario et al.
2017/0193432 A1 7/2017 Bernhardt
2017/0193461 A1 7/2017 Jonas et al.
2017/0193727 A1 7/2017 Van Horn et al.
2017/0200108 A1 7/2017 Au et al.
2017/0200275 A1 7/2017 McCloskey et al.

OTHER PUBLICATIONS

Datamax—O'Neil, "RL3/3e & RL4/4e Replacement Parts Catalog", downloaded Apr. 4, 2017, 13 pages.

* cited by examiner

REMOVABLY RETAINING A PRINT HEAD ASSEMBLY ON A PRINTER

FIELD OF THE INVENTION

The present invention relates to the field of printing and, more specifically, to systems, devices, and methods for removably retaining a print head assembly on a printer.

BACKGROUND

Generally speaking, printing systems (e.g., printers, copiers, fax machines, etc.) include a print head or print engine for applying visual images (e.g., graphics, text, etc.) on a page, label, or other type of printable media.

A thermal printer, for example, generates pressure and heat which is delivered via a thermal print head assembly to produce an image on print media. In this regard, varying the amount of pressure and/or heat delivered by the thermal print head (e.g., via adjustment mechanisms) results in a range of darker or lighter print being applied onto the media.

A sub-aspect relating to the amount of print head pressure applied during printing relates to pressure differences that may be applied by the print head across the width of the print media (i.e., pressure bias). For example, if the print head pressure applied is greater on one side of the print medium in comparison with the other side of the print medium, the side with heavier pressure applied will have darker print in comparison to the other side which will have lighter print.

With regard to the amount of pressure or pressure bias that is delivered to the print medium via the thermal print head, proper adjustment is needed in order to balance print quality (e.g., accurate black levels) with print head longevity.

In view of the foregoing, a foundational requirement for obtaining optimal outcomes in a printing process is a stable loading mechanism for the print head. In some instances, however, print head loading mechanisms have employed a cantilever structure having a retention/compression spring assembly located at a far side of the loading mechanism for removably retaining the print head on a printer. These types of loading mechanisms, however, can produce a twisting effect due to the cantilever design causing inconsistent pressure loading. This inconsistency may be particularly evident when this design is used across a range of different printers (e.g., varying between individual printers).

Another important aspect relating to print head loading mechanisms is ease-of-use or usability (e.g., a device's effectiveness, efficiency, user-satisfaction, etc.). If a device, such as a printer's print head loading mechanism, is not designed to achieve high usability in its environment then errors and/or delays can occur.

For example, certain printers employ print head loading mechanisms that require tools in order for a user to replace a print head that has reached the end of its useful lifespan (e.g., the print head has been damaged, prematurely failed, deteriorated, etc.). Requiring additional tools to replace a print head decreases a printer's usability given that a user must not only learn to how to perform the process with the tools, the user must consistently store the tools in an accessible location and locate the tools whenever the task needs to be performed.

Therefore, a need exists for more effective systems, devices, and methods for removably retaining a print head assembly on a printer, including but not limited to stable, user-friendly print head loading mechanisms that do not require additional tools in order for a user to replace the print head assembly.

SUMMARY

Accordingly, in one aspect, the present invention embraces a system including a bracket holding a print head assembly configured for printing on print media traveling on a media path, and a shaft configured for receiving and removably retaining the bracket on the shaft. The shaft includes a retaining assembly, a first shaft section having a profile geometry to allow the bracket to be received onto the shaft at the first shaft section, a second shaft section having a profile geometry preventing removal of the bracket from the shaft at the second shaft section, and a positioning assembly configured to resiliently engage the bracket. When the bracket is received on the shaft at the first shaft section, the positioning assembly is configured to engage and releasably reposition the bracket onto the second shaft section and against the retaining assembly.

In an exemplary embodiment, the bracket includes an attachment portion having a c-shaped opening including a slot, and the profile geometry of first shaft section includes facets for allowing the attachment portion of the bracket to be received onto the first shaft section.

In another exemplary embodiment, the shaft includes chamfers proximate the facets of first shaft section.

In yet another exemplary embodiment, the shaft is fixed and at least partially enclosed in a printer housing.

In yet another exemplary embodiment, the retaining assembly includes a stop surface at a first end of the shaft.

In yet another exemplary embodiment, the positioning assembly includes a compression spring and a plunger extending axially along the shaft to resiliently engage the bracket when the attachment portion of the bracket is received on the shaft at the first shaft section.

In yet another exemplary embodiment, the profile geometry of the second shaft section is a circle, and when the attachment portion of the bracket is removably positioned on the second shaft section, the c-shaped opening (i) allows the bracket to pivot about the shaft, and (ii) prevents detachment of the bracket from the second shaft section.

In yet another exemplary embodiment, the printer housing includes torsion springs. When the attachment portion of the bracket is received on the shaft at the first shaft section, the torsion springs are configured for supporting the bracket in a supported position and the bracket is slidably positionable between the first shaft section and the second shaft section.

In yet another exemplary embodiment, the printer housing includes a latch mechanism for securing the bracket in a releasably retained position on the shaft when the attachment portion of the bracket is positioned on the second shaft section and against the retaining assembly, and the torsion springs are compressed by the bracket when the latch mechanism secures the bracket.

In another aspect, the present invention embraces a printer including: a housing; a removable bracket holding a print head assembly configured for printing to print media traveling on a media path, the removable bracket having an attachment portion comprising an opening including a slot; and a shaft configured for receiving and removably retaining the removable bracket, wherein the shaft is fixed and at least partially enclosed in the housing. The shaft includes a retaining assembly having a stop surface at a first end of the shaft, a first shaft section having a profile geometry including flat faces to allow the attachment portion of the bracket to be received onto the shaft at the first shaft section, a second shaft section having a profile geometry preventing removal of the attachment portion from the shaft at the second shaft section, and a positioning assembly extending axially along the shaft to resiliently engage the bracket when the bracket is received on the shaft at the first shaft section. When the attachment portion of the bracket is received on the shaft at the first shaft section, the positioning assembly is configured to engage and releasably reposition the bracket onto the second shaft section and against the retaining assembly.

In an exemplary embodiment, the opening of the attachment portion of the bracket includes a c-shaped opening.

In another exemplary embodiment, the positioning assembly includes a compression spring and a plunger.

In yet another exemplary embodiment, the shaft includes chamfers proximate the flat faces of first shaft section.

In yet another exemplary embodiment, the profile geometry of the second shaft section is a circle. When the attachment portion of the bracket is positioned on the second shaft section, the c-shaped opening of the attachment portion of the bracket (i) allows the bracket to pivot about the shaft, and (ii) prevents detachment of the bracket from the second shaft section.

In yet another exemplary embodiment, the printer housing includes torsion springs. When the attachment portion of the bracket is received on the shaft at the first shaft section, the torsion springs are configured for supporting the bracket in a supported position and the bracket is slidably positionable between the first shaft section and the second shaft section.

In yet another exemplary embodiment, the housing includes a latch mechanism for securing the bracket into a releasably retained position on the shaft when the attachment portion of the bracket is positioned on the second shaft section and against the retaining assembly, and the torsion springs are compressed by the bracket when the latch mechanism secures the bracket.

In yet another aspect, the present invention embraces a method including: mounting a print head assembly onto a bracket having an attachment portion that includes an opening; removably positioning the attachment portion of the bracket onto a first section of a fixed shaft that is at least partially enclosed in a printer housing, the first shaft section having a profile geometry to allow the attachment portion of the bracket to be removably received onto the shaft at the first shaft section; resiliently engaging the bracket with a positioning assembly extending axially along the shaft; removably positioning the attachment portion of the bracket onto a second section of the shaft via the positioning assembly, the second shaft section having a profile geometry preventing removal of the attachment portion of the bracket from the shaft at the second shaft section; and removably positioning the attachment portion of the bracket against a stop surface of a retaining assembly via the positioning assembly.

In an exemplary embodiment, the method includes securing the bracket into a releasably retained position on the second portion of the shaft and against the stop surface via a latch mechanism.

In another exemplary embodiment, the method includes releasing the bracket from the releasably retained position via the latch mechanism, disengaging the positioning assembly from the bracket, and repositioning the attachment portion of the bracket onto the first section of the fixed shaft.

In yet another exemplary embodiment, the method includes removing the attachment portion of the bracket from the first section of the fixed shaft.

The foregoing illustrative summary, as well as other exemplary objectives and/or advantages of the invention, and the manner in which the same are accomplished, are further explained within the following detailed description and its accompanying drawings.

DETAILED DESCRIPTION

The present invention embraces improved systems, devices, and methods for removably retaining a print head assembly on a printer.

Figure 1:
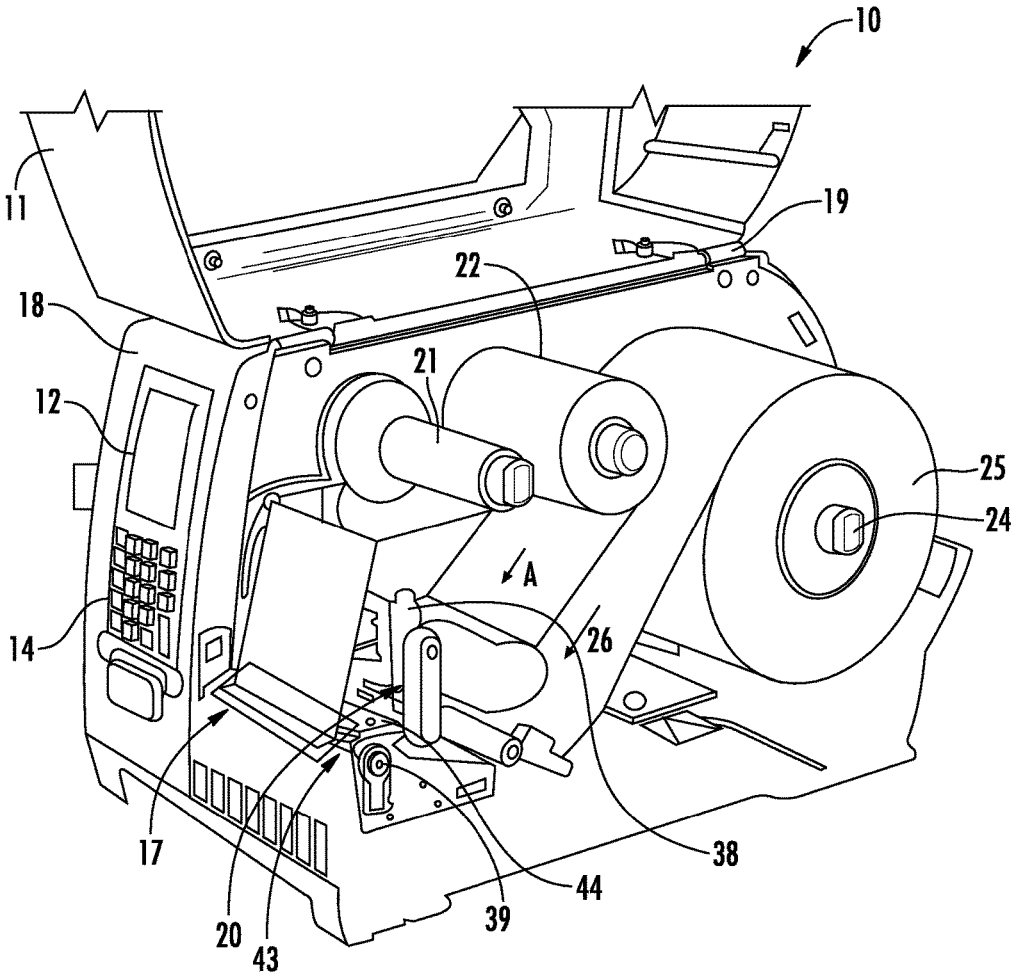
FIG. 1 graphically depicts an exemplary printer having a housing cover in an open position.

FIG. 1 depicts an exemplary printing system 10 which can utilize a print head loading mechanism in accord with the systems, devices, and methods of the present disclosure. Although the printing system depicted in FIG. 1 is a thermal printer 10, a thermal printer is simply one non-limiting example from a range of potentially applicable printing systems (e.g., ink jet printer, dot matrix printer, impact printer, laser printer, etc.).

The exemplary printer 10 includes a main housing portion 18 and a housing cover portion 11 which are joined by hinge 19. The printer 10 may be placed in a cover-open position (as shown in FIG. 1), or in a cover-closed position (not explicitly shown).

As shown in FIG. 1, the printer 10 can include a user interface display 12 (e.g., an LCD), one or more user input devices 14 (e.g., buttons are shown, but other input devices may be included such as a touchscreen, keypad, mouse, etc.), and a media slot 17 through which printed media exits (e.g., when the printer's cover is closed and the printer is performing printing operations).

A print station assembly 20 is at least partially mounted within the printer's housing. The exemplary print station assembly 20 includes a ribbon supply 22 for supplying (as illustrated by arrow A) transfer ribbon (e.g., ink ribbon composed at least partially of wax and/or resin) for use by an adjustable print head assembly 38 during printing operations, and a ribbon take up spool 21 for collecting used print ribbon. Other print station arrangements or components may be utilized, and the present disclosure is not limited to the illustrative arrangements provided herein.

The exemplary print head assembly 38 includes a thermal print head and can include adjustment mechanisms (e.g., screws for adjusting pressure and/or pressure bias, not explicitly shown).

A media dispenser 43 (e.g., operatively connected with a motor) is geared to a platen roller 39 for advancing print media 25 (e.g., labels on removable backing) from a media supply along a media transport pathway (illustrated by arrow 26) to the print head assembly 38 and, finally, through the media slot 17 (e.g., after printing). The exemplary print media supply or print roll support 24 of printer 10 is in the form of a spool or hub, but may take other forms.

Figure 2:
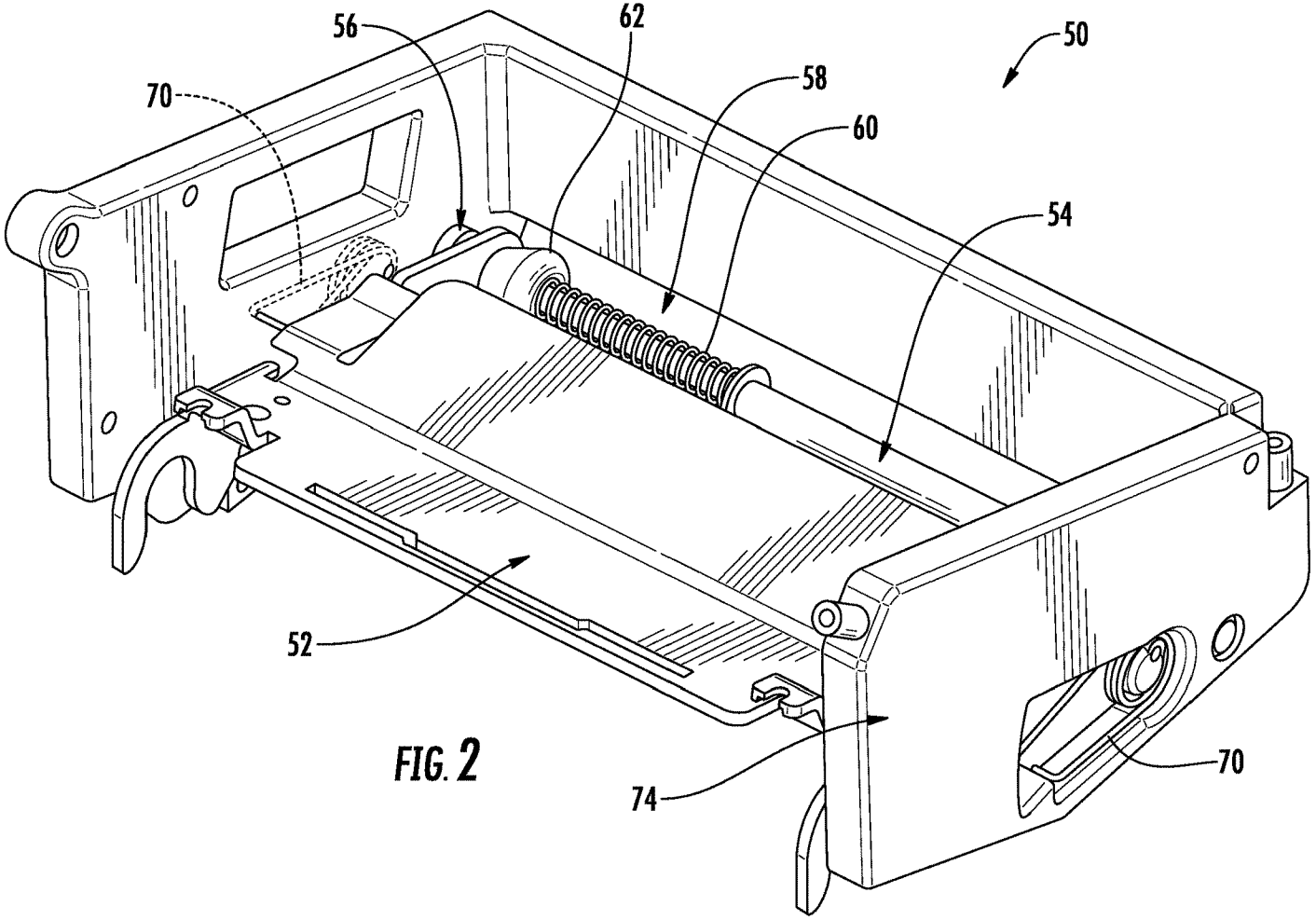
FIG. 2 graphically depicts a perspective view of an exemplary print head loading mechanism.

FIG. 2 depicts an exemplary print head loading mechanism/system 50. The exemplary print head loading mechanism can be utilized in connection with a printer or printing system such as, for example, the exemplary thermal printer 10 depicted in FIG. 1. The print head loading mechanism has two primary positioning arrangements; notably, a retain position (illustrated in FIG. 2), and a remove position (described below).

The exemplary print head loading mechanism 50 includes a bracket 52. The bracket 52 is used for holding (e.g., supporting, retaining, etc.) a print head assembly (e.g., print head assembly 38) for printing to print media traveling on a media path. The print head assembly may be fixed (e.g., removably attached, fastened, etc.) to the bracket 52 using various attachment mechanisms (e.g., fasteners, clips, etc.), and the present disclosure is not limited to any particular form.

A shaft 54 of the print head loading mechanism 50 is designed to receive and removably retain the bracket 52 on the shaft 54 (as further described below) thereby providing a stable loading base for the print head assembly. The shaft 54 can include a retaining assembly 56 portion which provides a datum face or face side (e.g., a stop surface) for securely retaining the bracket 52 on the shaft 54 when the print head loading mechanism 50 is placed into in a retained position.

In the retained position, a positioning assembly 58 extending axially along the shaft 54 resiliently engages portions of the bracket 52 and releasably retains the bracket 52 against the retaining assembly 56 which provides a stop surface to secure the bracket 52 into position about the shaft 54.

As shown in FIG. 2, the exemplary positioning assembly 58 can include a side-biasing compression spring 60 and a plunger 62 which collectively operate to push (e.g., thrust, press, etc.) the bracket 52 against the datum face or stop surface provided by the shaft's retaining assembly 56 portion. Although a compression spring and plunger arrangement are depicted in FIG. 2, the positioning assembly 58 may encompass other mechanisms or designs for engaging (resiliently or otherwise) the bracket 52, and the present disclosure is not limited to the illustrative examples provided herein.

As shown in FIG. 2, the exemplary print head loading mechanism 50 also includes torsion springs 70 (as further described below) and a latch mechanism 74 for securing the bracket 52 into the releasably retained position about the shaft 54.

Figure 3C:
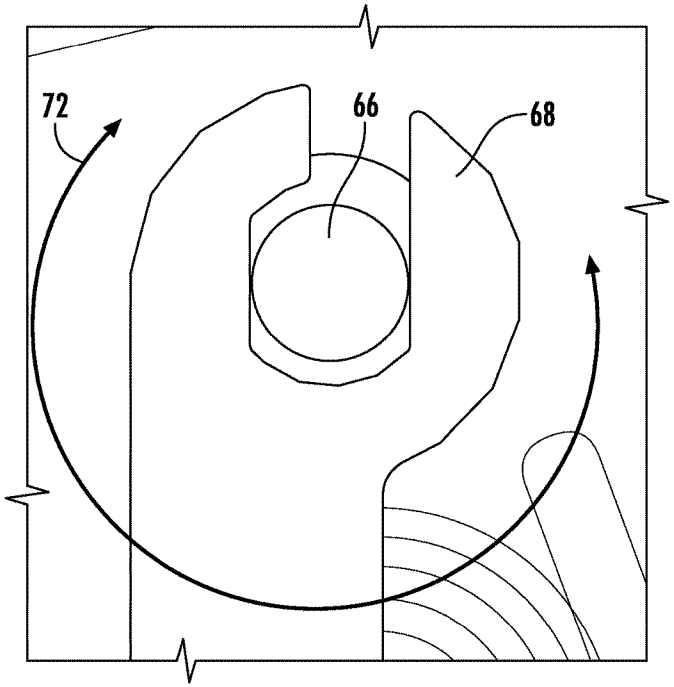
FIG. 3C graphically depicts a cross-section view of the exemplary print head loading mechanism along the labeled arrows shown in FIGS. 3A and 3B.
Figure 3:
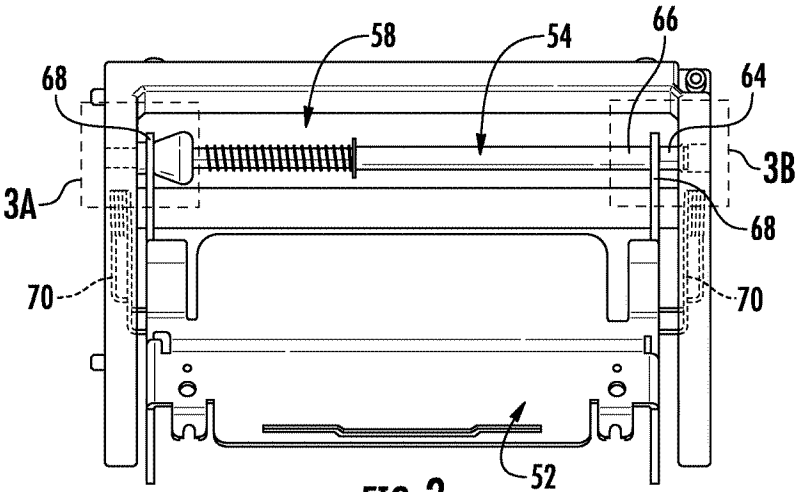
FIG. 3 graphically depicts a top view of the exemplary print head loading mechanism in a retained position.

FIGS. 3 to 3C further illustrate features of the exemplary print head loading mechanism 50 when positioned in a releasably retained position. In this regard, FIG. 3 is a top view of the exemplary print head loading mechanism 50 in the retained position, FIGS. 3A and 3B provide zoomed views of the consistently labeled portions of FIG. 3, and FIG. 3C illustrates a cross-section view along the labeled arrows shown in FIGS. 3A and 3B.

Figure 3B:
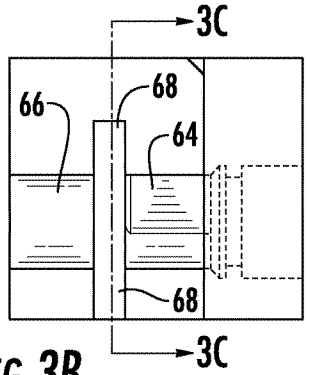
FIGS. 3A and 3B graphically depict zoomed views of portions of the exemplary print head loading mechanism shown in FIG. 3.
Figure 3A:
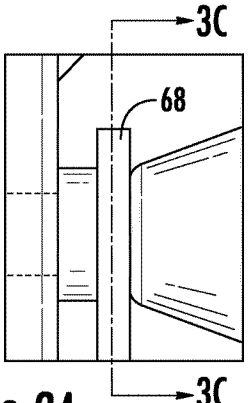

As best shown in the close-up or zoomed view at FIG. 3B, the shaft 54 includes first shaft sections 64 proximate the ends of the shaft 54 having a profile geometry to allow bracket attachment portions 68 to be received onto the shaft 54 at the first shaft sections 64. The shaft 54 further includes second shaft sections 66 having a profile geometry for preventing removal of the bracket attachment portions 68 from the shaft 54 at the second shaft sections 66.

Notably, as shown in the cross-sectional view of FIG. 3C, in the retain position the bracket attachment portions 68 are positioned on second shaft sections 66 of the shaft 54 having a full circle profile geometry. The full circle profile feature prevents the bracket attachment portions' c-shaped profile feature 68 from detaching from the shaft 54 due to the geometry of the respective features.

While the profile geometry of the second shaft sections 66 (e.g., full circle feature) prevents the print head bracket's attachment portions 68 (e.g., c-shaped feature) from fully detaching from the shaft 54, the bracket 52 can still pivot/rotate about the fixed shaft 54 when the bracket 52 is positioned on the second shaft sections 66 (as illustrated by arrow 72).

Figure 4:
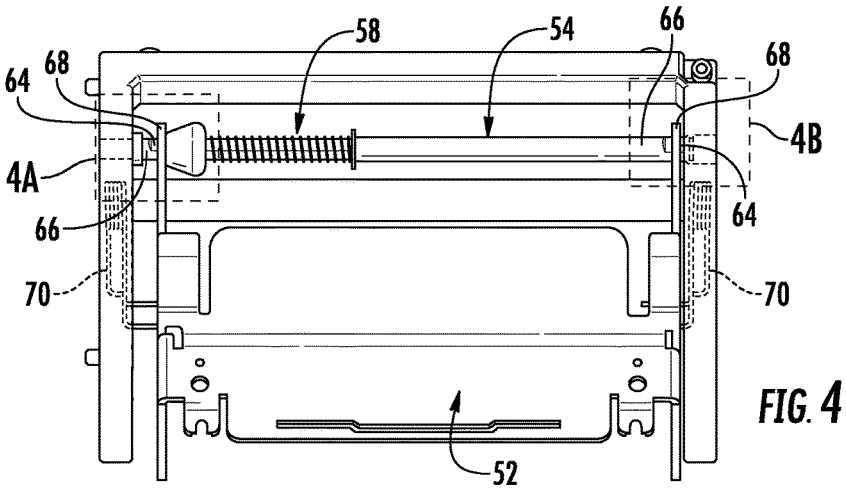
FIG. 4 graphically depicts a top view of the exemplary print head loading mechanism in a remove position.
Figure 4A:
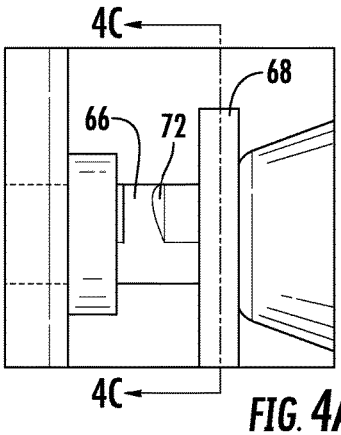
FIGS. 4A and 4B graphically depict zoomed views of portions of the exemplary print head loading mechanism shown in FIG. 4
Figure 4B:
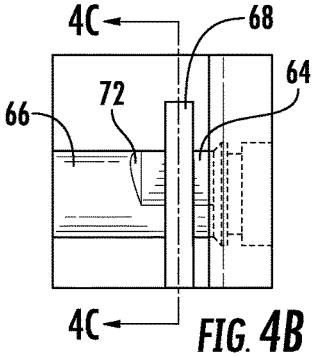
Figure 4C:
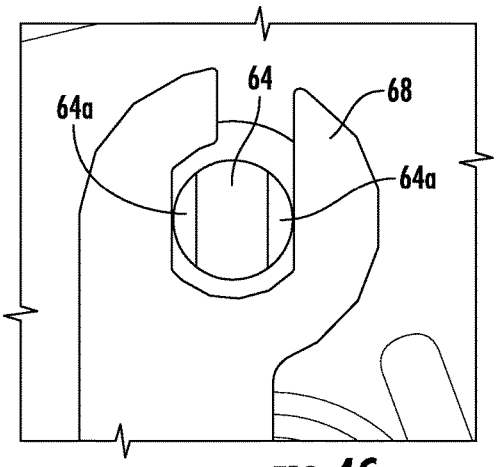
FIG. 4C graphically depicts a cross-section view of the exemplary print head loading mechanism along the labeled arrows shown in FIGS. 4A and 4B.
Figure 4D:
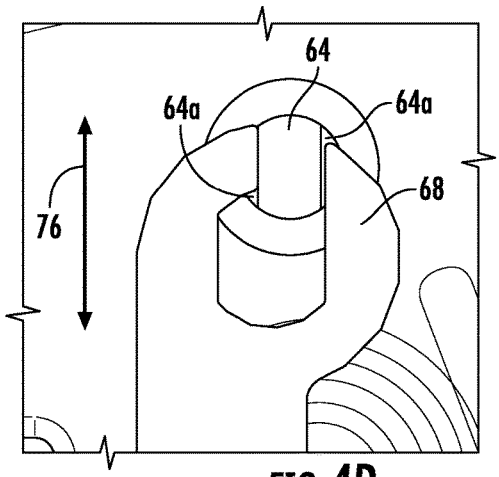
FIG. 4D graphically depicts another cross-section view from the perspective shown in FIG. 4C.

FIGS. 4 to 4D illustrate features of the exemplary print head loading mechanism 50 when positioned in the remove position. In this regard, FIG. 4 is a top view of the exemplary print head loading mechanism 50 in the remove position, FIGS. 4A and 4B provide zoomed views of the consistently labeled portions of FIG. 4, FIG. 4C illustrates a cross-section view along the labeled arrows shown in FIGS. 4A and 4B, and FIG. 4D provides another cross-section view as in FIG. 4C.

To transition from the retained position into the remove position, a user would slide the positioning assembly 58 (e.g., via the plunger 62) away from the shaft's retaining assembly 56 portion to release the attachment portions 68 of the bracket. The user would then slide the bracket's attachment portions 68 (e.g., the c-shaped feature) into the flat face or faceted zones 64*a* of the first shaft sections 64 (FIGS. 4C and 4D). Once the bracket's attachment portions 68 are in the flat face/facet zones 64*a* of the first shaft sections 64, the printhead bracket will be able to slide out of the fixed shaft (as shown in FIG. 4D).

In other embodiments, the positioning assembly 58 may include mechanisms such that the positioning assembly (e.g., via plunger 62 or other component) can be mated or otherwise releasably latched along the shaft when it is pulled back by the user so that the user is not required to hold the plunger with one hand and remove the bracket 52 with the other hand after the bracket attachment portions 68 are released (e.g., a thumb-screw, clip, anchor, etc.).

As shown in the cross-sectional view of FIG. 4D, in the remove position the bracket's attachment portions 68 are able to slide out (e.g., passing the total of four flat faces/facets 64*a* due to the respective profile geometries) allowing the bracket 52 to detach from the shaft 54 as illustrated by arrow 76.

Although exemplary arrangements and profile geometries for shaft sections and bracket attachment portions are described above, the present disclosure is not limited to the illustrative examples provided herein. Notably, the profile geometries of the respective features could take any number of shapes or configurations as long as the profiles respectively correspond for accomplishing retain and remove positioning. In other non-limiting examples, rather than facets or faces the first shaft sections could be of a smaller diameter circular cross-section in comparison to the second shaft sections, thereby sliding past suitably designed bracket attachment portions.

After removal, to reattach the bracket 54 (e.g., retaining/supporting a new print head), a user would slide the positioning assembly 58 away (e.g., via the plunger 62), engage or support the bracket attachment portions 68 onto the torsion springs 70, slide the attachment portions past the flat face zones 64*a* of the first shaft sections 64, then release the positioning assembly 58. In this regard, the plunger 62 of the positioning assembly 58 will push the attachment portions 68 past the lead in chamfers 72 (FIGS. 4A and 4B) on the shaft and into the full circle profile zone of the first shaft sections 66, which will retain the printhead bracket 52 on the shaft 54.

Although lead in chamfers 72 are described for assisting in the transition to the retained position, other transitions may be used (e.g., ramps, slopes, bevels, etc.), and in some contemplated embodiments chamfers or similar forms of assistance may be omitted based upon the profile geometries chosen.

The function of the torsional springs 72 is to lift and support the print head bracket 52 when the activation lever 74 is unlatched. The torsional springs 72 are designed so that the print head bracket 52 will be supported such that it will be able to slide along contact points when moving between the retain position and remove position.

Figure 5:
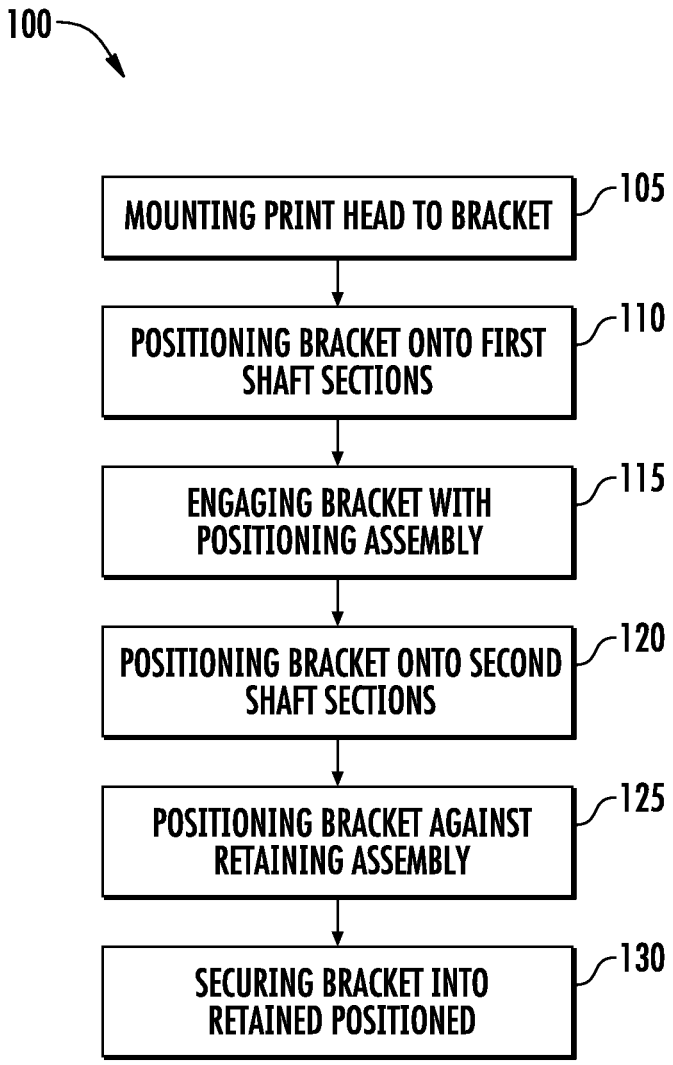
FIG. 5 is a flow chart illustrating an exemplary method for removably attaching a print head assembly via a print head loading mechanism.

Turning to FIG. 5, a flow chart illustrates an exemplary method 100 for removably attaching a print head assembly to a printer via a print head loading mechanism. At step 105, a print head assembly is mounted onto a bracket of a print head loading mechanism (e.g., loading mechanism/system 50 of the present disclosure).

At step 110, the attachment portion of the bracket is removably positioned onto first sections of a fixed shaft that is at least partially enclosed in a printer housing, the first shaft sections having a profile geometry (e.g., having facets or flat faces) to allow the attachment portion of the bracket to be removably received onto the shaft at the first shaft sections.

At step 115, the bracket is engaged with a resilient positioning assembly that extends axially along the shaft (e.g., via plunger 62).

At step 120, the attachment portion of the bracket is removably positioned onto second sections of the shaft via the engagement of the positioning assembly, the second shaft sections having a profile geometry (e.g., a full circle profile) preventing removal of the attachment portion of the bracket from the shaft at the second shaft sections.

At step 125, the attachment portion of the bracket is releasably positioned against a stop surface of a retaining assembly of the shaft via the engagement of the positioning assembly.

At step 130, the bracket is secured into a releasably retained position on the second portion of the shaft and against the stop surface via a latch mechanism.

Although not explicitly shown in FIG. 5, the print head loading mechanism also facilitates removal of the print head assembly via subsequent steps which include: releasing the bracket from the releasably retained position via the latch mechanism; disengaging the positioning assembly from the bracket; repositioning the attachment portion of the bracket onto the first sections of the fixed shaft; and removing the attachment portion of the bracket from the first section of the fixed shaft.

To supplement the present disclosure, this application incorporates entirely by reference the following commonly assigned patents, patent application publications, and patent applications:

U.S. Pat. No. 6,832,725; U.S. Pat. No. 7,128,266; U.S. Pat. No. 7,159,783; U.S. Pat. No. 7,413,127; U.S. Pat. No. 7,726,575; U.S. Pat. No. 8,294,969; U.S. Pat. No. 8,317,105; U.S. Pat. No. 8,322,622; U.S. Pat. No. 8,366,005; U.S. Pat. No. 8,371,507; U.S. Pat. No. 8,376,233; U.S. Pat. No. 8,381,979; U.S. Pat. No. 8,390,909; U.S. Pat. No. 8,408,464; U.S. Pat. No. 8,408,468; U.S. Pat. No. 8,408,469; U.S. Pat. No. 8,424,768; U.S. Pat. No. 8,448,863; U.S. Pat. No. 8,457,013; U.S. Pat. No. 8,459,557; U.S. Pat. No. 8,469,272; U.S. Pat. No. 8,474,712; U.S. Pat. No. 8,479,992; U.S. Pat. No. 8,490,877; U.S. Pat. No. 8,517,271; U.S. Pat. No. 8,523,076; U.S. Pat. No. 8,528,818; U.S. Pat. No. 8,544,737; U.S. Pat. No. 8,548,242; U.S. Pat. No. 8,548,420; U.S. Pat. No. 8,550,335; U.S. Pat. No. 8,550,354; U.S. Pat. No. 8,550,357; U.S. Pat. No. 8,556,174; U.S. Pat. No. 8,556,176; U.S. Pat. No. 8,556,177; U.S. Pat. No. 8,559,767; U.S. Pat. No. 8,599,957; U.S. Pat. No. 8,561,895; U.S. Pat. No. 8,561,903; U.S. Pat. No. 8,561,905; U.S. Pat. No. 8,565,107; U.S. Pat. No. 8,571,307; U.S. Pat. No. 8,579,200; U.S. Pat. No. 8,583,924; U.S. Pat. No. 8,584,945; U.S. Pat. No. 8,587,595; U.S. Pat. No. 8,587,697; U.S. Pat. No. 8,588,869; U.S. Pat. No. 8,590,789; U.S. Pat. No. 8,596,539; U.S. Pat. No. 8,596,542; U.S. Pat. No. 8,596,543; U.S. Pat. No. 8,599,271; U.S. Pat. No. 8,599,957; U.S. Pat. No. 8,600,158; U.S. Pat. No. 8,600,167; U.S. Pat. No. 8,602,309; U.S. Pat. No. 8,608,053; U.S. Pat. No. 8,608,071; U.S. Pat. No. 8,611,309; U.S. Pat. No. 8,615,487; U.S. Pat. No. 8,616,454; U.S. Pat. No. 8,621,123; U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,525; U.S. Pat. No. 8,794,526; U.S. Pat. No. 8,798,367; U.S. Pat. No. 8,807,431; U.S. Pat. No. 8,807,432; U.S. Pat. No. 8,820,630; U.S. Pat. No. 8,822,848; U.S. Pat. No. 8,824,692; U.S. Pat. No. 8,824,696; U.S. Pat. No. 8,842,849;

U.S. Pat. No. 8,844,822; U.S. Pat. No. 8,844,823; U.S. Pat. No. 8,849,019; U.S. Pat. No. 8,851,383; U.S. Pat. No. 8,854,633; U.S. Pat. No. 8,866,963; U.S. Pat. No. 8,868,421; U.S. Pat. No. 8,868,519; U.S. Pat. No. 8,868,802; U.S. Pat. No. 8,868,803; U.S. Pat. No. 8,870,074; U.S. Pat. No. 8,879,639; U.S. Pat. No. 8,880,426; U.S. Pat. No. 8,881,983; U.S. Pat. No. 8,881,987; U.S. Pat. No. 8,903,172; U.S. Pat. No. 8,908,995; U.S. Pat. No. 8,910,870; U.S. Pat. No. 8,910,875; U.S. Pat. No. 8,914,290; U.S. Pat. No. 8,914,788; U.S. Pat. No. 8,915,439; U.S. Pat. No. 8,915,444; U.S. Pat. No. 8,916,789; U.S. Pat. No. 8,918,250; U.S. Pat. No. 8,918,564; U.S. Pat. No. 8,925,818; U.S. Pat. No. 8,939,374; U.S. Pat. No. 8,942,480; U.S. Pat. No. 8,944,313; U.S. Pat. No. 8,944,327; U.S. Pat. No. 8,944,332; U.S. Pat. No. 8,950,678; U.S. Pat. No. 8,967,468; U.S. Pat. No. 8,971,346; U.S. Pat. No. 8,976,030; U.S. Pat. No. 8,976,368; U.S. Pat. No. 8,978,981; U.S. Pat. No. 8,978,983; U.S. Pat. No. 8,978,984; U.S. Pat. No. 8,985,456; U.S. Pat. No. 8,985,457; U.S. Pat. No. 8,985,459; U.S. Pat. No. 8,985,461; U.S. Pat. No. 8,988,578; U.S. Pat. No. 8,988,590; U.S. Pat. No. 8,991,704; U.S. Pat. No. 8,996,194; U.S. Pat. No. 8,996,384; U.S. Pat. No. 9,002,641; U.S. Pat. No. 9,007,368; U.S. Pat. No. 9,010,641; U.S. Pat. No. 9,015,513; U.S. Pat. No. 9,016,576; U.S. Pat. No. 9,022,288; U.S. Pat. No. 9,030,964; U.S. Pat. No. 9,033,240; U.S. Pat. No. 9,033,242; U.S. Pat. No. 9,036,054; U.S. Pat. No. 9,037,344; U.S. Pat. No. 9,038,911; U.S. Pat. No. 9,038,915; U.S. Pat. No. 9,047,098; U.S. Pat. No. 9,047,359; U.S. Pat. No. 9,047,420; U.S. Pat. No. 9,047,525; U.S. Pat. No. 9,047,531; U.S. Pat. No. 9,053,055; U.S. Pat. No. 9,053,378; U.S. Pat. No. 9,053,380; U.S. Pat. No. 9,058,526; U.S. Pat. No. 9,064,165; U.S. Pat. No. 9,064,165; U.S. Pat. No. 9,064,167; U.S. Pat. No. 9,064,168; U.S. Pat. No. 9,064,254; U.S. Pat. No. 9,066,032; U.S. Pat. No. 9,070,032; U.S. Pat. No. 9,076,459; U.S. Pat. No. 9,079,423; U.S. Pat. No. 9,080,856; U.S. Pat. No. 9,082,023; U.S. Pat. No. 9,082,031; U.S. Pat. No. 9,084,032; U.S. Pat. No. 9,087,250; U.S. Pat. No. 9,092,681; U.S. Pat. No. 9,092,682; U.S. Pat. No. 9,092,683; U.S. Pat. No. 9,093,141; U.S. Pat. No. 9,098,763; U.S. Pat. No. 9,104,929; U.S. Pat. No. 9,104,934; U.S. Pat. No. 9,107,484; U.S. Pat. No. 9,111,159; U.S. Pat. No. 9,111,166; U.S. Pat. No. 9,135,483; U.S. Pat. No. 9,137,009; U.S. Pat. No. 9,141,839; U.S. Pat. No. 9,147,096; U.S. Pat. No. 9,148,474; U.S. Pat. No. 9,158,000; U.S. Pat. No. 9,158,340; U.S. Pat. No. 9,158,953; U.S. Pat. No. 9,159,059; U.S. Pat. No. 9,165,174; U.S. Pat. No. 9,171,543; U.S. Pat. No. 9,183,425; U.S. Pat. No. 9,189,669; U.S. Pat. No. 9,195,844; U.S. Pat. No. 9,202,458; U.S. Pat. No. 9,208,366; U.S. Pat. No. 9,208,367; U.S. Pat. No. 9,219,836; U.S. Pat. No. 9,224,024; U.S. Pat. No. 9,224,027; U.S. Pat. No. 9,230,140; U.S. Pat. No. 9,235,553; U.S. Pat. No. 9,239,950; U.S. Pat. No. 9,245,492; U.S. Pat. No. 9,248,640; U.S. Pat. No. 9,250,652; U.S. Pat. No. 9,250,712; U.S. Pat. No. 9,251,411; U.S. Pat. No. 9,258,033; U.S. Pat. No. 9,262,633; U.S. Pat. No. 9,262,660; U.S. Pat. No. 9,262,662; U.S. Pat. No. 9,269,036; U.S. Pat. No. 9,270,782; U.S. Pat. No. 9,274,812; U.S. Pat. No. 9,275,388; U.S. Pat. No. 9,277,668; U.S. Pat. No. 9,280,693; U.S. Pat. No. 9,286,496; U.S. Pat. No. 9,298,964; U.S. Pat. No. 9,301,427; U.S. Pat. No. 9,313,377; U.S. Pat. No. 9,317,037; U.S. Pat. No. 9,319,548; U.S. Pat. No. 9,342,723; U.S. Pat. No. 9,361,882; U.S. Pat. No. 9,365,381; U.S. Pat. No. 9,373,018; U.S. Pat. No. 9,375,945; U.S. Pat. No. 9,378,403; U.S. Pat. No. 9,383,848; U.S. Pat. No. 9,384,374; U.S. Pat. No. 9,390,304; U.S. Pat. No. 9,390,596; U.S. Pat. No. 9,411,386; U.S. Pat. No. 9,412,242; U.S. Pat. No. 9,418,269; U.S. Pat. No. 9,418,270; U.S. Pat. No. 9,465,967; U.S. Pat. No. 9,423,318; U.S. Pat. No. 9,424,454; U.S. Pat. No. 9,436,860; U.S. Pat. No. 9,443,123; U.S. Pat. No. 9,443,222; U.S. Pat. No. 9,454,689; U.S. Pat. No. 9,464,885; U.S. Pat. No. 9,465,967; U.S. Pat. No. 9,478,983; U.S. Pat. No. 9,481,186; U.S. Pat. No. 9,487,113; U.S. Pat. No. 9,488,986; U.S. Pat. No. 9,489,782; U.S. Pat. No. 9,490,540; U.S. Pat. No. 9,491,729; U.S. Pat. No. 9,497,092; U.S. Pat. No. 9,507,974; U.S. Pat. No. 9,519,814; U.S. Pat. No. 9,521,331; U.S. Pat. No. 9,530,038; U.S. Pat. No. 9,572,901; U.S. Pat. No. 9,558,386; U.S. Pat. No. 9,606,581; U.S. Pat. No. 9,646,189; U.S. Pat. No. 9,646,191; U.S. Pat. No. 9,652,648; U.S. Pat. No. 9,652,653; U.S. Pat. No. 9,656,487; U.S. Pat. No. 9,659,198; U.S. Pat. No. 9,680,282; U.S. Pat. No. 9,697,401; U.S. Pat. No. 9,701,140;

U.S. Design Pat. No. D702,237;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D734,339;
U.S. Design Pat. No. D737,321;
U.S. Design Pat. No. D754,205;
U.S. Design Pat. No. D754,206;
U.S. Design Pat. No. D757,009;
U.S. Design Pat. No. D760,719;
U.S. Design Pat. No. D762,604;
U.S. Design Pat. No. D766,244;
U.S. Design Pat. No. D777,166;
U.S. Design Pat. No. D771,631;
U.S. Design Pat. No. D783,601;
U.S. Design Pat. No. D785,617;
U.S. Design Pat. No. D785,636;
U.S. Design Pat. No. D790,505;
U.S. Design Pat. No. D790,546;

International Publication No. 2013/163789;

U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0194692;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;

U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0332996;
U.S. Patent Application Publication No. 2014/0001267;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131443;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0191684;
U.S. Patent Application Publication No. 2014/0191913;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0231500;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0332590;
U.S. Patent Application Publication No. 2014/0351317;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0009338;
U.S. Patent Application Publication No. 2015/0014416;
U.S. Patent Application Publication No. 2015/0021397;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0049347;
U.S. Patent Application Publication No. 2015/0051992;
U.S. Patent Application Publication No. 2015/0053769;
U.S. Patent Application Publication No. 2015/0062366;
U.S. Patent Application Publication No. 2015/0063215;
U.S. Patent Application Publication No. 2015/0088522;
U.S. Patent Application Publication No. 2015/0096872;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0149946;
U.S. Patent Application Publication No. 2015/0161429;
U.S. Patent Application Publication No. 2015/0178523;
U.S. Patent Application Publication No. 2015/0178537;
U.S. Patent Application Publication No. 2015/0178685;
U.S. Patent Application Publication No. 2015/0181109;
U.S. Patent Application Publication No. 2015/0199957;
U.S. Patent Application Publication No. 2015/0210199;
U.S. Patent Application Publication No. 2015/0212565;
U.S. Patent Application Publication No. 2015/0213647;
U.S. Patent Application Publication No. 2015/0220753;
U.S. Patent Application Publication No. 2015/0220901;
U.S. Patent Application Publication No. 2015/0227189;
U.S. Patent Application Publication No. 2015/0236984;
U.S. Patent Application Publication No. 2015/0239348;
U.S. Patent Application Publication No. 2015/0242658;
U.S. Patent Application Publication No. 2015/0248572;
U.S. Patent Application Publication No. 2015/0254485;
U.S. Patent Application Publication No. 2015/0261643;
U.S. Patent Application Publication No. 2015/0264624;
U.S. Patent Application Publication No. 2015/0268971;
U.S. Patent Application Publication No. 2015/0269402;
U.S. Patent Application Publication No. 2015/0288689;
U.S. Patent Application Publication No. 2015/0288896;
U.S. Patent Application Publication No. 2015/0310243;
U.S. Patent Application Publication No. 2015/0310244;
U.S. Patent Application Publication No. 2015/0310389;
U.S. Patent Application Publication No. 2015/0312780;
U.S. Patent Application Publication No. 2015/0327012;

U.S. Patent Application Publication No. 2016/0014251;
U.S. Patent Application Publication No. 2016/0025697;
U.S. Patent Application Publication No. 2016/0026838;
U.S. Patent Application Publication No. 2016/0026839;
U.S. Patent Application Publication No. 2016/0040982;
U.S. Patent Application Publication No. 2016/0042241;
U.S. Patent Application Publication No. 2016/0057230;
U.S. Patent Application Publication No. 2016/0062473;
U.S. Patent Application Publication No. 2016/0070944;
U.S. Patent Application Publication No. 2016/0092805;
U.S. Patent Application Publication No. 2016/0101936;
U.S. Patent Application Publication No. 2016/0104019;
U.S. Patent Application Publication No. 2016/0104274;
U.S. Patent Application Publication No. 2016/0109219;
U.S. Patent Application Publication No. 2016/0109220;
U.S. Patent Application Publication No. 2016/0109224;
U.S. Patent Application Publication No. 2016/0112631;
U.S. Patent Application Publication No. 2016/0112643;
U.S. Patent Application Publication No. 2016/0117627;
U.S. Patent Application Publication No. 2016/0124516;
U.S. Patent Application Publication No. 2016/0125217;
U.S. Patent Application Publication No. 2016/0125342;
U.S. Patent Application Publication No. 2016/0125873;
U.S. Patent Application Publication No. 2016/0133253;
U.S. Patent Application Publication No. 2016/0171597;
U.S. Patent Application Publication No. 2016/0171666;
U.S. Patent Application Publication No. 2016/0171720;
U.S. Patent Application Publication No. 2016/0171775;
U.S. Patent Application Publication No. 2016/0171777;
U.S. Patent Application Publication No. 2016/0174674;
U.S. Patent Application Publication No. 2016/0178479;
U.S. Patent Application Publication No. 2016/0178685;
U.S. Patent Application Publication No. 2016/0178707;
U.S. Patent Application Publication No. 2016/0179132;
U.S. Patent Application Publication No. 2016/0179143;
U.S. Patent Application Publication No. 2016/0179368;
U.S. Patent Application Publication No. 2016/0179378;
U.S. Patent Application Publication No. 2016/0180130;
U.S. Patent Application Publication No. 2016/0180133;
U.S. Patent Application Publication No. 2016/0180136;
U.S. Patent Application Publication No. 2016/0180594;
U.S. Patent Application Publication No. 2016/0180663;
U.S. Patent Application Publication No. 2016/0180678;
U.S. Patent Application Publication No. 2016/0180713;
U.S. Patent Application Publication No. 2016/0185136;
U.S. Patent Application Publication No. 2016/0185291;
U.S. Patent Application Publication No. 2016/0186926;
U.S. Patent Application Publication No. 2016/0188861;
U.S. Patent Application Publication No. 2016/0188939;
U.S. Patent Application Publication No. 2016/0188940;
U.S. Patent Application Publication No. 2016/0188941;
U.S. Patent Application Publication No. 2016/0188942;
U.S. Patent Application Publication No. 2016/0188943;
U.S. Patent Application Publication No. 2016/0188944;
U.S. Patent Application Publication No. 2016/0189076;
U.S. Patent Application Publication No. 2016/0189087;
U.S. Patent Application Publication No. 2016/0189088;
U.S. Patent Application Publication No. 2016/0189092;
U.S. Patent Application Publication No. 2016/0189284;
U.S. Patent Application Publication No. 2016/0189288;
U.S. Patent Application Publication No. 2016/0189366;
U.S. Patent Application Publication No. 2016/0189443;
U.S. Patent Application Publication No. 2016/0189447;
U.S. Patent Application Publication No. 2016/0189489;
U.S. Patent Application Publication No. 2016/0192051;
U.S. Patent Application Publication No. 2016/0202951;
U.S. Patent Application Publication No. 2016/0202958;
U.S. Patent Application Publication No. 2016/0202959;
U.S. Patent Application Publication No. 2016/0203021;
U.S. Patent Application Publication No. 2016/0203429;
U.S. Patent Application Publication No. 2016/0203797;
U.S. Patent Application Publication No. 2016/0203820;
U.S. Patent Application Publication No. 2016/0204623;
U.S. Patent Application Publication No. 2016/0204636;
U.S. Patent Application Publication No. 2016/0204638;
U.S. Patent Application Publication No. 2016/0227912;
U.S. Patent Application Publication No. 2016/0232891;
U.S. Patent Application Publication No. 2016/0292477;
U.S. Patent Application Publication No. 2016/0294779;
U.S. Patent Application Publication No. 2016/0306769;
U.S. Patent Application Publication No. 2016/0314276;
U.S. Patent Application Publication No. 2016/0314294;
U.S. Patent Application Publication No. 2016/0316190;
U.S. Patent Application Publication No. 2016/0323310;
U.S. Patent Application Publication No. 2016/0325677;
U.S. Patent Application Publication No. 2016/0327614;
U.S. Patent Application Publication No. 2016/0327930;
U.S. Patent Application Publication No. 2016/0328762;
U.S. Patent Application Publication No. 2016/0330218;
U.S. Patent Application Publication No. 2016/0343163;
U.S. Patent Application Publication No. 2016/0343176;
U.S. Patent Application Publication No. 2016/0364914;
U.S. Patent Application Publication No. 2016/0370220;
U.S. Patent Application Publication No. 2016/0372282;
U.S. Patent Application Publication No. 2016/0373847;
U.S. Patent Application Publication No. 2016/0377414;
U.S. Patent Application Publication No. 2016/0377417;
U.S. Patent Application Publication No. 2017/0010141;
U.S. Patent Application Publication No. 2017/0010328;
U.S. Patent Application Publication No. 2017/0010780;
U.S. Patent Application Publication No. 2017/0016714;
U.S. Patent Application Publication No. 2017/0018094;
U.S. Patent Application Publication No. 2017/0046603;
U.S. Patent Application Publication No. 2017/0047864;
U.S. Patent Application Publication No. 2017/0053146;
U.S. Patent Application Publication No. 2017/0053147;
U.S. Patent Application Publication No. 2017/0053647;
U.S. Patent Application Publication No. 2017/0055606;
U.S. Patent Application Publication No. 2017/0060316;
U.S. Patent Application Publication No. 2017/0061961;
U.S. Patent Application Publication No. 2017/0064634;
U.S. Patent Application Publication No. 2017/0083730;
U.S. Patent Application Publication No. 2017/0091502;
U.S. Patent Application Publication No. 2017/0091706;
U.S. Patent Application Publication No. 2017/0091741;
U.S. Patent Application Publication No. 2017/0091904;
U.S. Patent Application Publication No. 2017/0092908;
U.S. Patent Application Publication No. 2017/0094238;
U.S. Patent Application Publication No. 2017/0098947;
U.S. Patent Application Publication No. 2017/0100949;
U.S. Patent Application Publication No. 2017/0108838;
U.S. Patent Application Publication No. 2017/0108895;
U.S. Patent Application Publication No. 2017/0118355;
U.S. Patent Application Publication No. 2017/0123598;
U.S. Patent Application Publication No. 2017/0124369;
U.S. Patent Application Publication No. 2017/0124396;
U.S. Patent Application Publication No. 2017/0124687;
U.S. Patent Application Publication No. 2017/0126873;
U.S. Patent Application Publication No. 2017/0126904;
U.S. Patent Application Publication No. 2017/0139012;
U.S. Patent Application Publication No. 2017/0140329;
U.S. Patent Application Publication No. 2017/0140731;
U.S. Patent Application Publication No. 2017/0147847;
U.S. Patent Application Publication No. 2017/0150124;

U.S. Patent Application Publication No. 2017/0169198;
U.S. Patent Application Publication No. 2017/0171035;
U.S. Patent Application Publication No. 2017/0171703;
U.S. Patent Application Publication No. 2017/0171803;
U.S. Patent Application Publication No. 2017/0180359;
U.S. Patent Application Publication No. 2017/0180577;
U.S. Patent Application Publication No. 2017/0181299;
U.S. Patent Application Publication No. 2017/0190192;
U.S. Patent Application Publication No. 2017/0193432;
U.S. Patent Application Publication No. 2017/0193461;
U.S. Patent Application Publication No. 2017/0193727;
U.S. Patent Application Publication No. 2017/0199266;
U.S. Patent Application Publication No. 2017/0200108; and
U.S. Patent Application Publication No. 2017/0200275.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A system, comprising:

a bracket, the bracket holding a print head assembly configured for printing on print media traveling on a media path; and a shaft configured for receiving and removably retaining the bracket on the shaft, the shaft comprising:

a retaining assembly;

a first shaft section having a profile geometry to allow the bracket to be received onto the shaft at the first shaft section;

a second shaft section having a profile geometry preventing removal of the bracket from the shaft at the second shaft section; and a positioning assembly configured to resiliently engage the bracket;

wherein, when the bracket is received on the shaft at the first shaft section, the positioning assembly is configured to engage and releasably reposition the bracket onto the second shaft section and against the retaining assembly.

2. The system of claim 1, wherein the bracket comprises an attachment portion having a c-shaped opening including a slot; and wherein the profile geometry of first shaft section comprises facets for allowing the attachment portion of the bracket to be received onto the first shaft section.

3. The system of claim 2, wherein the shaft comprises chamfers proximate the facets of first shaft section.

4. The system of claim 2, wherein the shaft is fixed and at least partially enclosed in a printer housing.

5. The system of claim 4, wherein the retaining assembly comprises a stop surface at a first end of the shaft.

6. The system of claim 5, wherein the positioning assembly comprises a compression spring and a plunger extending axially along the shaft to resiliently engage the bracket when the attachment portion of the bracket is received on the shaft at the first shaft section.

7. The system of claim 6, wherein the profile geometry of the second shaft section comprises a circle; and wherein, when the attachment portion of the bracket is removably positioned on the second shaft section the c-shaped opening (i) allows the bracket to pivot about the shaft, and (ii) prevents detachment of the bracket from the second shaft section.

8. The system of claim 7, wherein the printer housing comprises torsion springs; and wherein, when the attachment portion of the bracket is received on the shaft at the first shaft section, the torsion springs are configured for supporting the bracket in a supported position whereby the bracket is slidably positionable between the first shaft section and the second shaft section.

9. The system of claim 8, wherein the printer housing comprises a latch mechanism for securing the bracket in a releasably retained position on the shaft when the attachment portion of the bracket is positioned on the second shaft section and against the retaining assembly, and whereby the torsion springs are compressed by the bracket when the latch mechanism secures the bracket.

10. A printer, comprising:

a housing;

a removable bracket holding a print head assembly configured for printing to print media traveling on a media path, the removable bracket having an attachment portion comprising an opening including a slot;

a shaft configured for receiving and removably retaining the removable bracket, wherein the shaft is fixed and at least partially enclosed in the housing, the shaft comprising:

a retaining assembly comprising a stop surface at a first end of the shaft;

a first shaft section having a profile geometry comprising flat faces to allow the attachment portion of the bracket to be received onto the shaft at the first shaft section;

a second shaft section having a profile geometry preventing removal of the attachment portion from the shaft at the second shaft section; and a positioning assembly extending axially along the shaft to resiliently engage the bracket when the bracket is received on the shaft at the first shaft section;

wherein, when the attachment portion of the bracket is received on the shaft at the first shaft section, the positioning assembly is configured to engage and releasably reposition the bracket onto the second shaft section and against the retaining assembly.

11. The printer of claim 10, wherein the opening of the attachment portion of the bracket comprises a c-shaped opening.

12. The printer of claim 11, wherein the positioning assembly comprises a compression spring and a plunger.

13. The system of claim 12, wherein the shaft comprises chamfers proximate the flat faces of the first shaft section.

14. The system of claim 13, wherein the profile geometry of the second shaft section comprises a circle; and wherein, when the attachment portion of the bracket is positioned on the second shaft section, the c-shaped opening of the attachment portion of the bracket (i) allows the bracket to pivot about the shaft, and (ii) prevents detachment of the bracket from the second shaft section.

15. The system of claim 14, wherein the printer housing comprises torsion springs; and wherein, when the attachment portion of the bracket is received on the shaft at the first shaft section, the torsion springs are configured for supporting the bracket in a supported position whereby the bracket is slidably positionable between the first shaft section and the second shaft section.

16. The system of claim 15, wherein the housing comprises a latch mechanism for securing the bracket into a releasably retained position on the shaft when the attachment portion of the bracket is positioned on the second shaft section and against the retaining assembly, and whereby the torsion springs are compressed by the bracket when the latch mechanism secures the bracket.

17. A method, comprising:

mounting a print head assembly onto a bracket, the bracket having an attachment portion comprising an opening;

removably positioning the attachment portion of the bracket onto a first section of a fixed shaft that is at least partially enclosed in a printer housing, the first shaft section having a profile geometry to allow the attachment portion of the bracket to be removably received onto the shaft at the first shaft section;

resiliently engaging the bracket with a positioning assembly extending axially along the shaft;

removably positioning the attachment portion of the bracket onto a second section of the shaft via the positioning assembly, the second shaft section having a profile geometry preventing removal of the attachment portion of the bracket from the shaft at the second shaft section; and removably positioning the attachment portion of the bracket against a stop surface of a retaining assembly via the positioning assembly.

18. The method of claim 17, comprising securing the bracket into a releasably retained position on the second portion of the shaft and against the stop surface via a latch mechanism.

19. The method of claim 18, comprising releasing the bracket from the releasably retained position via the latch mechanism;

disengaging the positioning assembly from the bracket; and repositioning the attachment portion of the bracket onto the first section of the fixed shaft.

20. The method of claim 19, comprising removing the attachment portion of the bracket from the first section of the fixed shaft.

* * * * *